US005290154A

United States Patent [19]

Kotlarek et al.

[11] Patent Number: 5,290,154

[45] Date of Patent: Mar. 1, 1994

[54] SCROLL COMPRESSOR REVERSE PHASE AND HIGH DISCHARGE TEMPERATURE PROTECTION

[75] Inventors: Peter A. Kotlarek; Jerry A. Rood, both of Onalaska; Bill P. Simmons, La Crosse, all of Wis.

[73] Assignee: American Standard Inc., New York, N.Y.

[21] Appl. No.: 995,728

[22] Filed: Dec. 23, 1992

[51] Int. Cl.[5] ..... F04B 47/08

[52] U.S. Cl. ..... 417/272

[58] Field of Search ..... 417/292, 291

[56] References Cited

U.S. PATENT DOCUMENTS

| | | | |
|---|---|---|---|
| 4,560,330 | 12/1985 | Murayama et al. | 418/55 |
| 4,820,130 | 4/1989 | Eber et al. | 417/32 |
| 4,828,462 | 5/1989 | McBurnett | 417/291 |
| 4,840,545 | 6/1989 | Moilanen | 417/301 |
| 4,934,910 | 6/1990 | Utter | 418/55 |
| 5,090,880 | 2/1992 | Mashimo | 417/310 |
| 5,141,407 | 8/1992 | Ramsey et al. | 417/292 |
| 5,186,613 | 2/1993 | Kotlarek et al. | 417/291 |

FOREIGN PATENT DOCUMENTS

| | | |
|---|---|---|
| 61-218792 | 9/1986 | Japan . |
| 2-221696 | 9/1990 | Japan . |

*Primary Examiner*—Richard E. Gluck

*Attorney, Agent, or Firm*—William J. Beres; William O'Driscoll; Peter D. Ferguson

[57] ABSTRACT

A low side scroll compressor is protected from both the potentially damaging effects of improper electrical hookup and the development of high discharge temperatures by apparatus disposed in a passage which communicates between the suction pressure portion and a discharge pressure portion of the compressor. The apparatus operates to permit gas flow from the suction to the discharge pressure portion of the compressor through a protective passage, such as when the compressor runs backwards due to miswiring, so as to avert damage to the scroll members. The apparatus permits the flow of gas from the discharge to the suction pressure portion of the compressor through the passage when the temperature of the discharge gas produced by the compressor exceeds a predetermined temperature indicative of an abnormal compressor operating condition. The resulting gas flow in the latter case causes the compressor motor to de-energize.

12 Claims, 6 Drawing Sheets

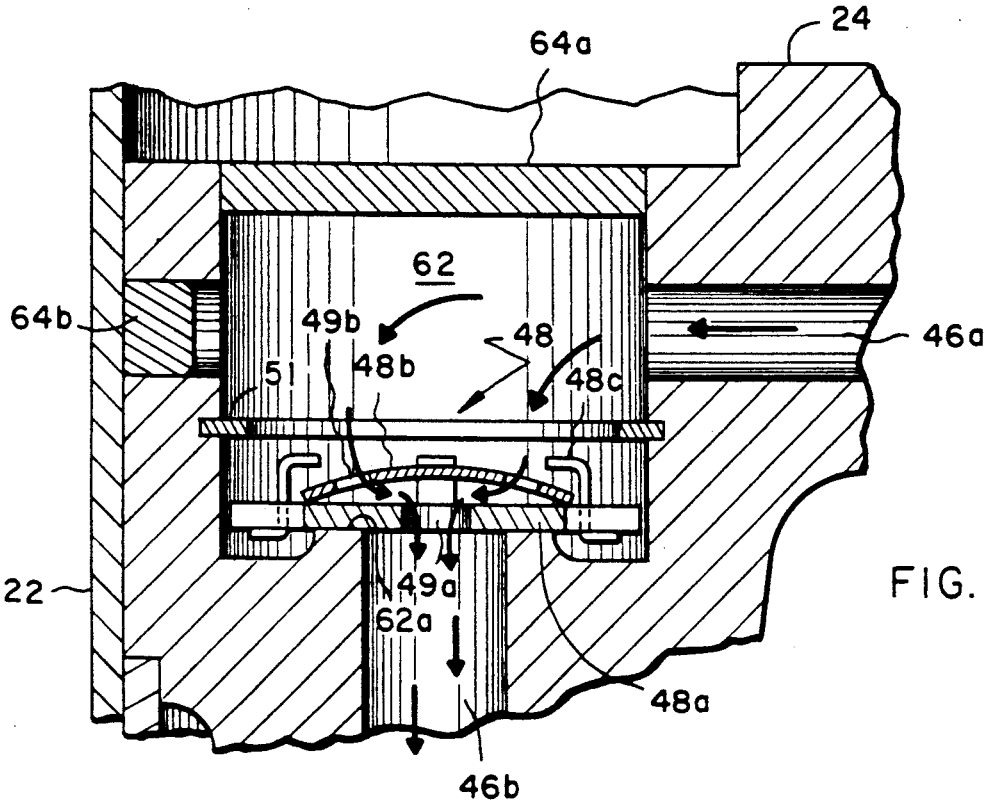
FIG. 10
FIG. 12
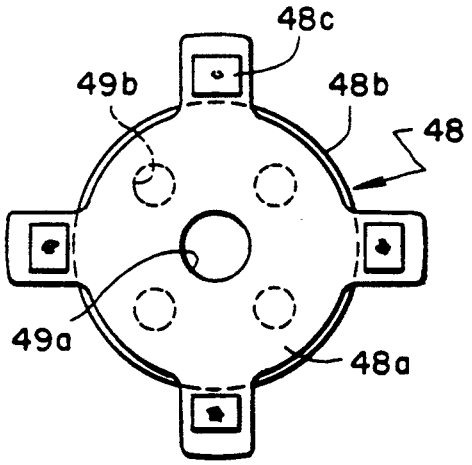
FIG. 11
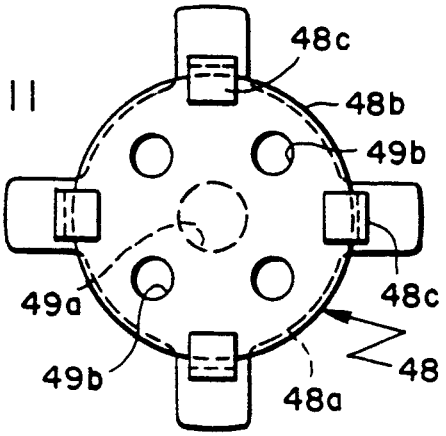

SCROLL COMPRESSOR REVERSE PHASE AND HIGH DISCHARGE TEMPERATURE PROTECTION

The subject matter of this patent application relates to U.S. Pat. No. 5,186,613.

TECHNICAL FIELD

This invention relates generally to the protection of scroll compressors from damage which can result from the existence of abnormal operating conditions. More specifically, this invention relates to protective apparatus within a low side scroll compressor which selectively permits the internal bi-directional flow of refrigerant gas between a suction and a discharge pressure portion of the compressor to prevent damage to the scroll members as a result of its improper electrical hookup or the effects of abnormally high discharge temperatures.

BACKGROUND OF THE INVENTION

Hermetic compressors, including those of the scroll type, are of a high or a low side type. A high side compressor is one in which the motor is disposed in the discharge or high pressure portion of the hermetic compressor shell. A low side compressor is one in which the motor is disposed in the suction or low pressure portion of the shell.

A common problem in hermetic rotary compressors, including those of the scroll type, is the tendency of compressed refrigerant gas to flow back from the discharge pressure portion of the compressor shell, through the compression mechanism and back to the suction side of the shell upon compressor shutdown. This backflow is as a result of the natural tendency of the system within which the compressor is employed to equalize its internal pressure when the compressor is de-energized. Such backflow, if not prevented, can cause the high speed reverse rotation of the compression mechanism which can lead to potentially serious compressor damage.

The prevention of such backflow upon compressor shutdown is typically accomplished by the disposition of a discharge check valve downstream of the aperture through which gas is discharged from the compressor's compression mechanism. The discharge check valve is closed by the initial backflow of refrigerant gas to and through the compressor which begins immediately upon compressor shutdown. The closing of the discharge check valve may be assisted or accelerated by a biasing member such as a spring.

In scroll compressors having compression mechanisms protected from gas-driven reverse rotation by apparatus such as a discharge check valve, a problem arises when the compressor is electrically connected in an improper manner. Such improper electrical connection can cause the motor to run in a direction which is reverse from the direction it is intended to run. This problem is recognized in U.S. Pat. Nos. 4,820,130; 4,840,545 and the concurrently pending patent application referred to above, all of which are assigned to the assignee of the present invention.

Briefly, when a scroll compressor having a discharge check valve is miswired so that it is caused to run backwards, the pockets defined between the scroll wraps, rather than moving radially inward and decreasing in volume, move radially outward and expand in volume in a pumping action. In effect, the scroll mechanism functions, under such circumstances, as a gas expander or pump as opposed to a compressor.

The expansion of the pockets defined by the scroll members under such circumstances causes low and even negative pressures to develop within the pockets because the discharge check valve, being closed, gives the mechanism no source of gas to pump from. As a result, the scroll members are drawn tightly together which can eventually result, to the extent the compressor motor continues to run backwards, in severe damage and possibly to the destruction of the compressor.

Still another difficulty and potential source for damage in scroll compressors is the development of high discharge gas temperatures while the compressor is in operation. Such high discharge temperatures can result from, among other things, the operation of the compressor in a system where pressure ratios develop that are outside of the compressor's normal operating range. Such high discharge gas temperatures can cause thermal growth within the compressor, and, in particular, thermal growth of the scroll wraps. The thermal expansion of the scroll wraps can lead to high wrap tip contact loads and the galling of the wrap tips.

Compressor protection with respect to the development of high discharge temperatures has historically involved the disposition of a temperature sensor on a discharge line leading from the compressor's hermetic shell or the disposition of an internally mounted temperature sensor closely proximate to the location at which discharge gas issues from between the scroll wraps into the discharge portion of the compressor shell. The former arrangement can be inadequate because the externally mounted sensor, which is remote from the critical scroll wrap location, may not sense the existence of high discharge temperatures sufficiently early to prevent damage to the scroll members.

The latter arrangement, employing an internally mounted temperature sensor, while faster acting than arrangements employing externally mounted sensors, requires the mounting of the sensor in the discharge pressure portion of the compressor's hermetic shell. As a result, in low side compressors the leads of a sensor mounted in the discharge pressure portion of the shell must be routed out of the hermetic shell or at least out of the discharge pressure portion of the shell in order for the signal produced by the sensor to be used to shut down the compressor's motor under appropriate circumstances.

The need continues to exist to protect hermetic scroll compressors of the low side type from the damage which can result from their improper electrical hookup or from the occurrence of high discharge temperatures while eliminating the need to position a temperature sensor in the discharge portion of the compressor shell and the need to route sensor leads through or out of the shell's discharge pressure portion.

SUMMARY OF THE INVENTION

With the above in mind, it is an object of the present invention to prevent the damage which can result from the improper electrical hookup of a scroll compressor motor and the reverse rotation of the driven scroll member which results therefrom.

It is another object of the present invention to provide protection for a scroll compressor against the damage which can result from the development of high compressor discharge temperatures.

It is a further object of the present invention to provide protection for a scroll compressor against the damage which can result from the reverse rotation of the driven scroll member and from the development of high discharge temperatures through the action of a combined compressor protection arrangement.

It is a still further object of the present invention to provide scroll compressor protection against the damaging effects of reverse direction scroll rotation and abnormally high discharge temperatures in a manner which eliminates the need for disposing a discharge temperature sensor internal of the discharge pressure portion of the compressor's shell and the need to route sensor leads out of the discharge portion of the compressor.

It is a further object of the present invention to provide scroll compressor protection against the reverse direction scroll rotation and high discharge temperatures in a manner which permits controlled bi-directional gas flow between the high and low side of a compressor upon the occurrence of an abnormal operating condition where the amount of gas flow required to protect against a first abnormal operating condition is different from the amount of gas flow which is required to protect against the results of a second abnormal operating condition.

These and other objects of the present invention will be appreciated when the attached Drawing Figures and the Description of the Preferred Embodiment found hereinbelow are considered.

The present invention is directed to an arrangement which selectively permits the flow of refrigerant gas (i.) in a first direction and at a first rate within a scroll compressor in response to the development of high compressor discharge temperatures and (ii.) in the opposite direction and at a second rate within the compressor in response to the reverse direction rotation of the driven scroll member but which (iii.) prevents any such flow under normal compressor operating conditions. Such permitted internal refrigerant flow during other than normal operating conditions is through an interruptible passage entirely internal of the shell of the compressor which communicates between the suction pressure portion of the shell and a portion of the compression apparatus through which discharge gas flows during normal operation.

The controlled internal refrigerant flow permitted by the protective arrangement of the present invention prevents compressor damage which would otherwise result from the development of high discharge temperatures of the development of sub-suction pressures between the scroll members such as can result from the reverse direction rotation of the compressor motor due to improper electrical hookup. When the circumstances of high discharge temperature or sub-suction pressures between the scroll members do not exist, refrigerant flow through the internal passage is prevented.

The present invention contemplates the disposition of protective valve apparatus in a passage which communicates between the suction portion of the compressor shell and a location downstream of the aperture through which compressed gas is discharged from the compression apparatus in the normal course of compressor operation. The valve apparatus is, however, located upstream of the discharge check valve if one is employed within the compressor and preferably includes a two-piece free-floating assembly which is disposed in an enlarged portion of the internal refrigerant passage. One of the two-pieces of the assembly is, itself, permitted to move within the valve assembly.

During normal compressor operation, discharge pressure gas seats the valve assembly, including its movable portion, such that the assembly blocks the internal gas passage with the result that no gas flow is permitted therethrough. Under the circumstance of reverse direction scroll rotation, with the compression apparatus acting as an expander, the valve assembly lifts as a whole, as will its movable portion individually, under the impetus of gas flowing through the internal gas passage from the suction pressure portion of the shell. A continuous supply of a gas for the compression apparatus to pump from under the abnormal reverse direction rotation condition is therefore provided.

Upon the occurrence of abnormally high discharge temperatures, the moveable portion of the valve assembly, which is thermally responsive, deforms in a predetermined manner to open the internal refrigerant gas passage to the flow of gas from the discharge port of the compression apparatus to the suction pressure portion of the shell. The abnormally hot discharge pressure gas is vented through the refrigerant passage into the proximity of a thermally responsive element causing the compressor motor to de-energize. The compressor is thereby protected from high discharge temperatures in a manner which does not require the use of temperature sensor disposed in the discharge pressure portion of the compressor shell or the routing of sensor leads out of that portion of the compressor.

BRIEF DESCRIPTION OF THE DRAWINGS

FIGS. 8, 9 and 10 are enlarged views of the valve assemblies of the compressor protection arrangement of the present invention taken respectively from FIGS. 4, 5 and 6 and illustrating the position of the valve assembly under the normal and the two respective abnormal conditions illustrated therein.

FIGS. 11 and 12 are, respectively, top and bottom views of the valve assembly of the present invention.

DESCRIPTION OF THE PREFERRED EMBODIMENT

Figure 1:
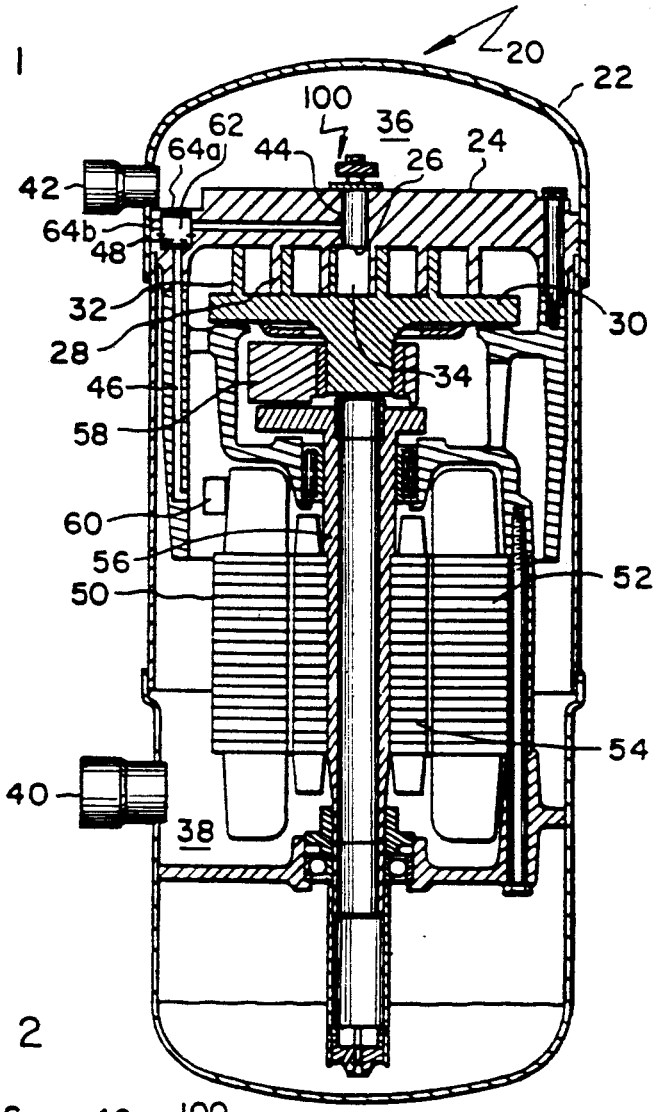
FIG. 1 shows a cross-sectional view of a low-side scroll compressor embodying the present invention.
Figure 2:
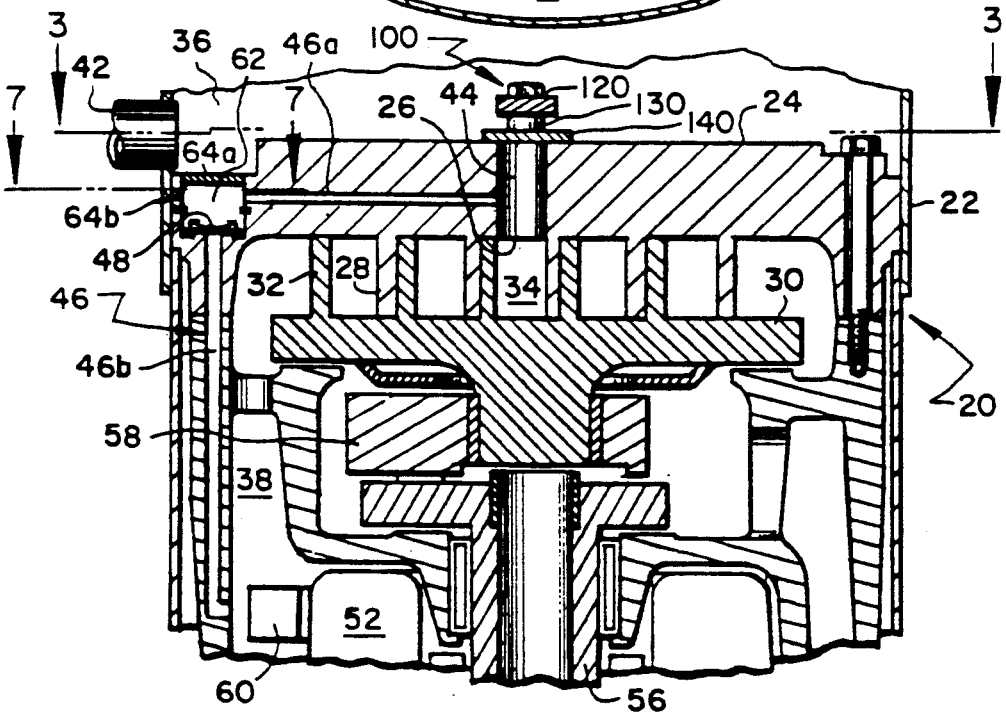
FIG. 2 is an enlarged partial cross section of the upper portion of the compressor illustrated in FIG. 1 with the compressor in its de-energized state.
Figure 3:
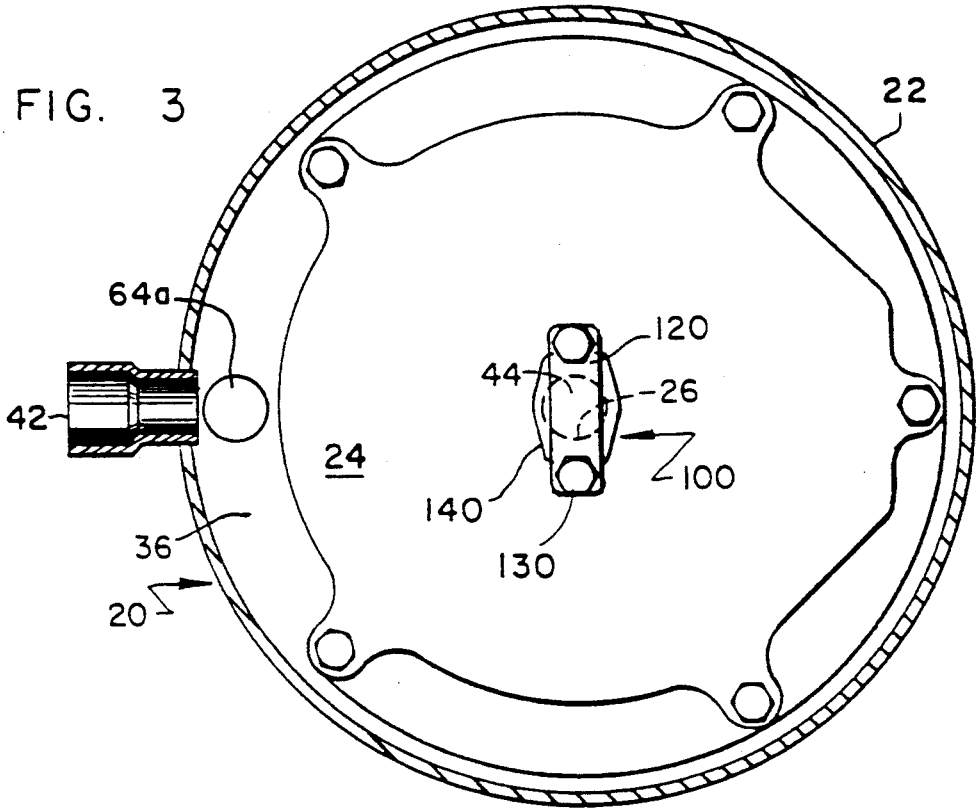
FIG. 3 is a view taken along line 3—3 of FIG. 2.

Referring first to FIGS. 1, 2 and 3, compressor 20 has a hermetic shell 22, in which a fixed scroll member 24 is disposed. Fixed scroll member 24 defines a discharge aperture 26 and has an involute wrap 28 extending from it. An orbiting scroll member 30 is likewise disposed in shell 22 and likewise has an extending involute wrap 32 which is disposed in interleaving engagement with the involute wrap 28 of fixed scroll member 24.

The operating principles of scroll compressors are well known and described, such as, for instance, in U.S. Pat. No. 4,934,910 which is assigned to the assignee of the present invention and which is incorporated herein by reference. These general operating principles will therefore not be discussed in great detail other than as necessary to describe the present invention.

Scroll members 24 and 30 and their interleaved involute wraps 28 and 32 cooperate to define a plurality of compression pockets therebetween. The volume of the pockets decrease and the pockets move in a radially inward direction toward discharge aperture 26 when compressor 20 is in normal operation. The pockets and their movement are created by the relative orbital motion of the scroll members. Discharge pocket 34 is the radially innermost pocket defined by the scroll members and is in flow communication with discharge aperture 26 of the fixed scroll member.

Fixed scroll member 24 serves to divide hermetic shell 22 into a discharge pressure portion 36 and a suction pressure portion 38. It should be understood that the division of hermetic shell 22 into a discharge pressure portion 36 and suction pressure portion 38 can be accomplished by means other than the use of fixed scroll member 24, such as by the use of an independent barrier or seal member.

Suction port 40 is provided to permit gas at suction pressure to enter suction pressure portion 38 of hermetic shell 22. Suction gas enters the radially outermost pocket defined by the scroll members, which is cyclically formed and closed by the orbital movement of the orbiting scroll member with respect to the fixed scroll member. A discharge port 42 is provided in shell 22 to permit the discharge of compressed gas from the discharge portion 36 of the compressor.

Communicating between discharge aperture 26 and the discharge portion 36 of shell 22 is a discharge passage 44 through which compressed gas is communicated from discharge pocket 34, through aperture 26 and to shell discharge portion 36 when the compressor is in normal operation. A passage 46, in which a valve assembly 48 is disposed and which is comprised of passage portions **46*a* and 46*b*, communicates between discharge passage 44 and shell suction pressure portion 38** as will more thoroughly be described below.

Compressor 20 is driven by an electric motor 50 which is disposed in the suction pressure portion 38 of shell 22 and is therefore a low side compressor. Motor 50 includes a stator 52 and rotor 54. A drive shaft 56 connects motor rotor 54 and orbiting scroll member 28 through a swing link mechanism 58. Motor 50 includes a thermally actuated line break device 60 associated with stator 52. The line break device is disposed adjacent the opening of passage 46 into suction pressure portion 38 of the compressor shell.

Although compressor 20 is illustrated as including a swing link mechanism for radial compliance purposes, it should be understood that the present invention is equally applicable to scroll compressors which do not make use of swing link apparatus including scroll compressors of the fixed throw type. It must also be understood that although device 60 is preferably a thermally actuated line break device which is integral with the compressor motor, other thermally actuated devices are suitable for use and are within the scope of the present invention. Finally, it will be appreciated that the present invention is also applicable to compressors of the corotating type with modifications that will be apparent to those skilled in the art.

Compressor 20 includes means, operable when the pressure in discharge pressure portion 36 of shell 22 exceeds the pressure in discharge pocket 34 (such as upon compressor shutdown), for preventing the backflow of refrigerant gas from the discharge pressure portion of the shell back through passage 44 and into discharge pocket 34 between the scroll members. In that regard, discharge check valve assembly 100 is disposed atop fixed scroll member 24 in the illustrated embodiment. It will be appreciated that the discharge check valve could be disposed downstream of the location as described with respect to the preferred embodiment such as internal of discharge port 42 or in a discharge line (not shown) connected to discharge port 42.

Discharge check valve assembly 100 is comprised of a stop member 120 which is fixedly disposed between guide posts 130 as is best illustrated in FIG. 3. Valve assembly 100 includes a free-floating valve element 140 which operates between a closed position in which it seats over and closes passage 44 from discharge portion 36 and an open position in which the flow of discharge gas through passage 44 lifts the valve element upward so that it seats against stop member 120.

Figure 4:
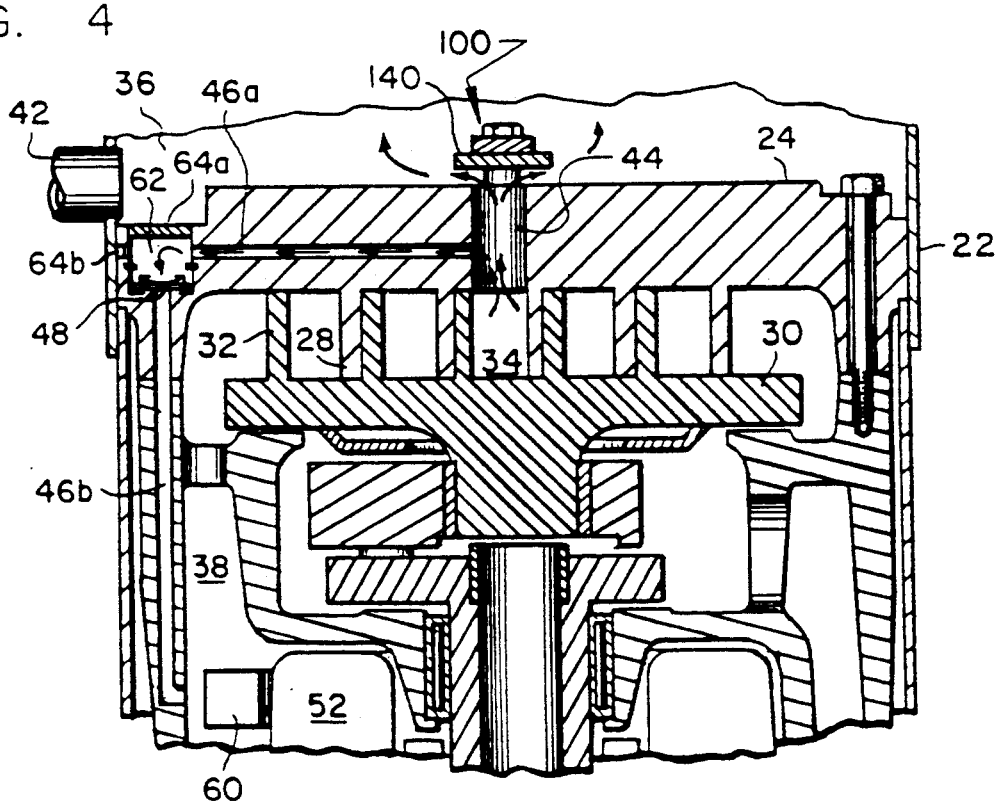
FIG. 4 is a reproduction of FIG. 2 showing the disposition of the compressor discharge check valve and the gas flow path through the fixed scroll member when the compressor is in normal operation.

When compressor 20 is shut down and pressures within shell 22 are equalized, valve element 140 rests over discharge passage 44, as illustrated in FIG. 2, and is maintained there by force of gravity. When compressor 22 starts and discharge gas begins to flow through passage 44 from pocket 34, the flow of compressed gas lifts valve element 140 and maintains it in the position resting against stop member 120 as is illustrated in FIG. 4.

Upon compressor shutdown, when orbiting scroll member 30 ceases to be driven by motor 50 and when the scroll members cease to compress gas between them, previously compressed gas will immediately begin to flow back out of the discharge pressure portion of the shell, into passage 44 and through the scroll members in an attempt, by the system in which the compressor is employed, to equalize its internal pressure. In doing so, gravity and the backflowing gas will immediately carry valve element 140 downward so as to close off passage 144 from discharge portion 36 which prevents further backflow. The elevated pressure in discharge portion 36, so long as it exists, will assist in maintaining valve element 140 seated. Pressure across the valve element and within the compressor will equalize as pressures equalize across the system in which the compressor is employed.

The near immediate closure of the discharge valve assembly prevents the continued rapid backflow of gas from discharge portion 36 upon compressor shutdown and, more importantly, prevents such continued backflow to the scroll members from the system in which compressor 20 is employed. It will be appreciated that the system will contain a relatively much larger volume of discharge pressure gas at such time as the compressor shuts down than will be found in the discharge portion of the compressor shell. If orbiting scroll member 28 were permitted to be driven in the reverse direction by such backflow for too long a period of time, damage to the compressor would result as has been explained.

Because valve element 140 will be in its closed position whenever the compressor is at rest, including those instances where the compressor has not yet been initially wired or has been electrically disconnected for some reason, it will be appreciated that if motor 50 is initially or subsequently miswired such that orbiting scroll member 28 is driven in a direction opposite from that which is intended, the pockets defined by the scroll member, including discharge pocket 34 will be caused to expand and move radially outward. As a result, compressor 20 will function, in effect, as a gas expander.

In doing so, the scroll members will act against the closed discharge check valve assembly 100 so that pressure in the compression pockets, including discharge pocket 34, will be pulled down and become less than suction pressure. The pressure may, in fact, approach vacuum because closed valve element 140 prevents the flow of gas from the discharge pressure portion of the compressor which eliminates a source of gas from which the miswired apparatus can pump. Under such conditions, the tips of the wraps of the scroll members are drawn into high frictional contact with the opposing scroll member and severe compressor damage can occur.

As has also been mentioned, the compressor can be damaged by high discharge temperatures which can occur, for instance, due to operation of the compressor at pressure ratios outside of its normal operating range. Such temperatures can cause thermal growth of the scroll wrap elements with the result that contact loads on the wrap tips become exceedingly high.

Figure 5:
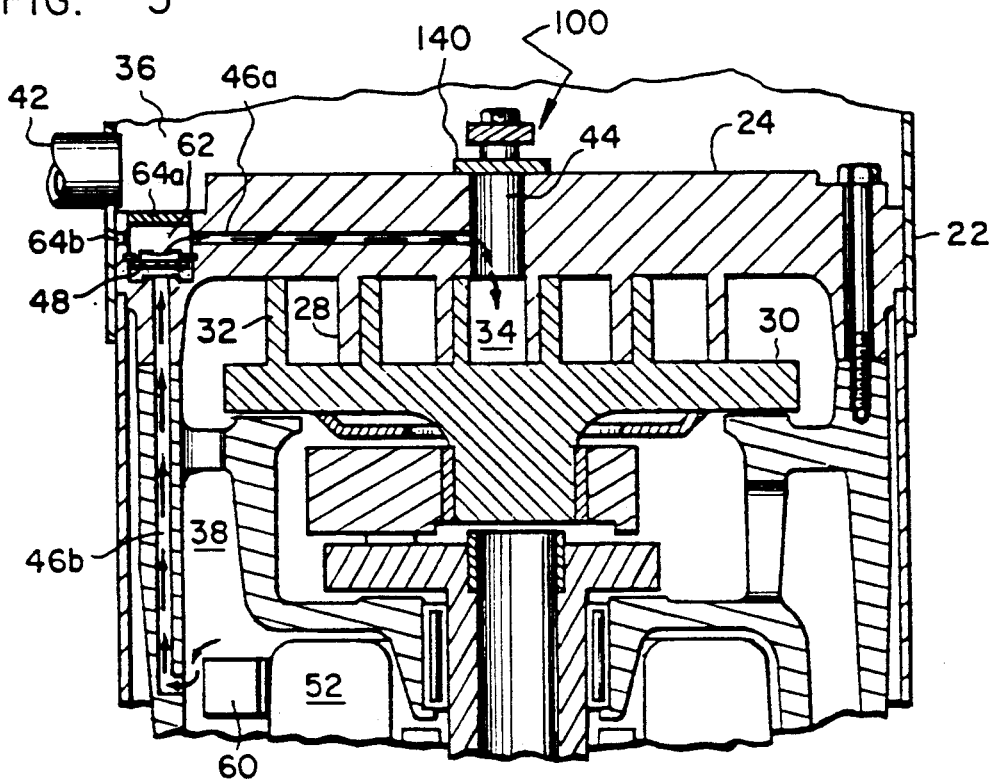
FIG. 5 is a reproduction of FIG. 2 illustrating the operation of the protective arrangement of the present invention and gas flow therethrough with the compressor running in the reverse direction from which it is intended or when subsuction pressures are otherwise caused to develop in the pockets defined by the scroll members.
Figure 6:
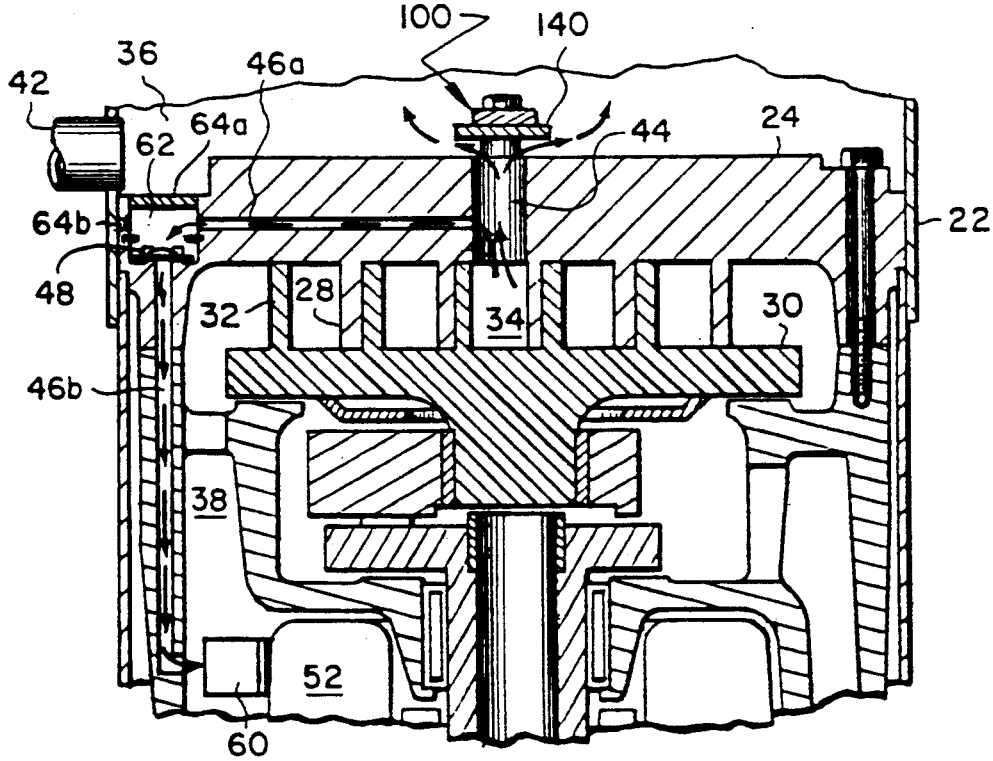
FIG. 6 is a reproduction of FIG. 4 illustrating the operation of the protective arrangement of the present invention and the gas flow therethrough when abnormally high discharge temperatures occur while the compressor is in operation.

Referring now to FIGS. 5 and 6, the operation of the protective apparatus of the present invention will be discussed in view of the described abnormal operating conditions. Referring first to FIG. 5, operation of the protective apparatus to prevent compressor damage by the development of sub-suction pressures between the scroll members, such as might occur upon the reverse direction rotation of the orbiting scroll member, will be considered.

As has previously been indicated, in the event that motor 50 of compressor 20 is miswired so that it runs backward, compressor 20 will function as an expander. The expansion of the compression pockets, including discharge pocket 34, causes a reduction in pressure in those pockets such that pressure is less than suction pressure will occur within the pockets in a very short time.

Since discharge pocket 34 is open to discharge passage 44 which, under such circumstances, is closed off from the discharge pressure portion of the compressor by the seating of valve element 140 over passage 44, the development of a sub-suction pressure within discharge pocket 34 will result in the development of sub-suction pressures both in discharge passage 44 and in the portion **46*a* of passage 46. Passage portion 46*a* is on the discharge pressure side of valve assembly 48 and opens into passage 44. Valve assembly 48 is free-floating within chamber 62 which is defined in passage 46 and its movement within chamber 62 is limited by retainer 51. Chamber 62, in this embodiment, is closed plugs 64*a* and 64*b* and defines a seating surface 62*a***.

The development of sub-suction pressure in passage portion **46*a* will cause a pressure gradient to occur across valve assembly 48 since the portion 46*b* of passage 46, which is located on the opposite side of valve assembly 48, is open to the suction pressure portion of the compressor. However, when discharge pressure exists in discharge passage 44, such pressure will be communicated through passage portion 46*a* into chamber 62 and will maintain valve assembly 48 seated so as to prevent the flow of gas from passage portion 46*a* into passage portion 46*b***.

If the compressor is miswired such that the orbiting scroll member is driven in a reverse direction or if sub-suction pressures should otherwise develop in the compression chambers between the scroll members, the suction pressure found in passage **46*b* will exceed the reduced pressure found in passage portion 46*a*. This condition causes valve assembly 48 to be lifted, as a whole, by the resulting flow of suction pressure gas through passage 46 from the suction pressure portion of the compressor into discharge passage 44 and into discharge chamber 34**.

Therefore, upon the occurrence of even a slight pressure differential across free-floating valve assembly 48, as would be indicative of the development of sub-suction pressure in the discharge pocket defined by the scroll wraps, suction pressure gas will begin to flow through passage 46 and into discharge pocket 34 to prevent the development of excessive contact loads on the scroll wrap tips by providing a source of gas for the compression apparatus to pump from under this abnormal operating condition. At such time as pressure greater than suction pressure comes to exist in discharge pocket 34 and discharge passage 44, such as by the proper wiring of the compressor and the resulting compression of gas between the scroll members, valve assembly 48 will be caused to seat within chamber 62 by discharge pressure and will prevent the flow of gas through passage 46 under what is a normal operating condition.

Referring concurrently now to FIGS. 7, 8, 9, 10, 11 and 12, it will be appreciated that valve assembly 48 is comprised of a first portion **48*a* and a second portion 48*b* which is retained in valve assembly 48 by clips 48*c*. Valve portion 48*a* defines an aperture 49*a* while valve portion 48*b* defines apertures 49*b***.

Generally speaking, valve portion **48*a* is selected such that even under abnormal compressor operating conditions, including high discharge temperature, it will not deform. Valve member 48*b***, however, is selected from a thermally responsive material having characteristics such that it deforms in a predetermined manner when exposed to a predetermined temperature. In the case of this invention such predetermined temperatures would indicate the existence of abnormally high discharge temperatures.

Valve portion **48*b*, as is illustrated, is retained in assembly 48** in a manner which permits it to move both in the context of its deformation due to exposure to high discharge gas temperatures and in the context of physically moving within the valve assembly. As will be further explained, this arrangement permits relatively high volume gas flow from the suction pressure portion to the discharge pressure portion of the compressor when reverse direction scroll rotation occurs and relatively low volume gas flow from the discharge pressure portion to the suction pressure portion of the shell when high discharge temperatures exist.

Figure 8:
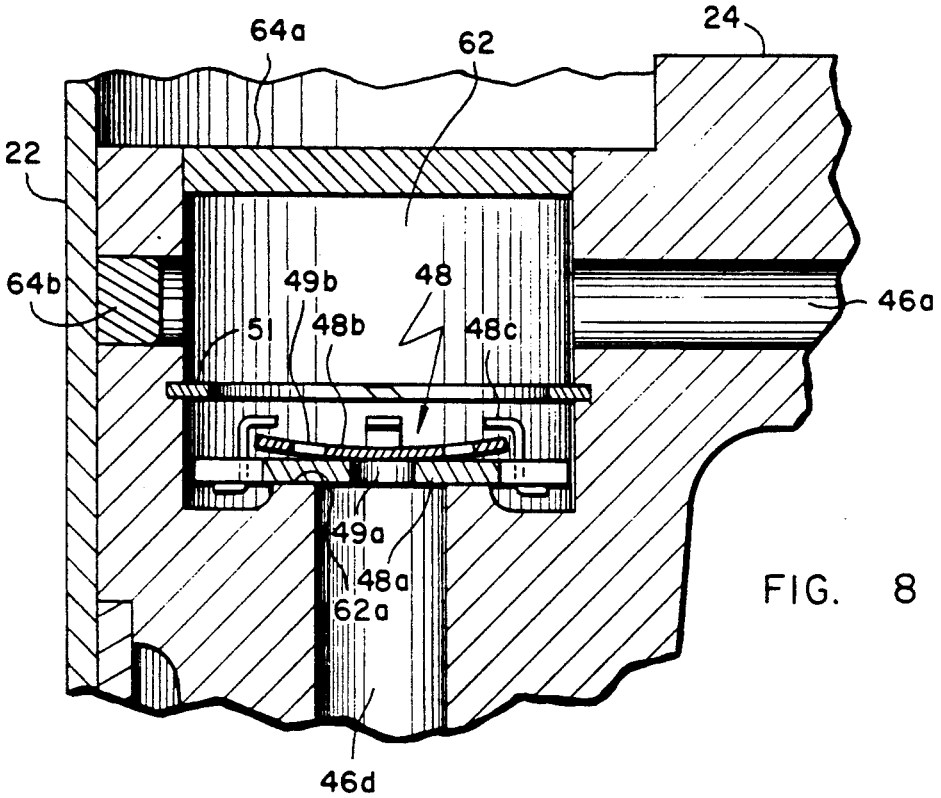

Referring now to FIGS. 4 and 8, it will be appreciated that during normal compressor operation discharge pressure gas causes valve portion 48*b* of the valve assembly to seat on valve portion 48*a* which in turn seats on seating surface 62*a* in chamber 62. Under these circumstances the solid central portion of valve portion 48*b* seats over and closes aperture 49*a* of valve portion 48*a* thereby preventing the flow of gas from the discharge pressure portion to the suction pressure portion of the compressor through passage 46.

Figure 9:
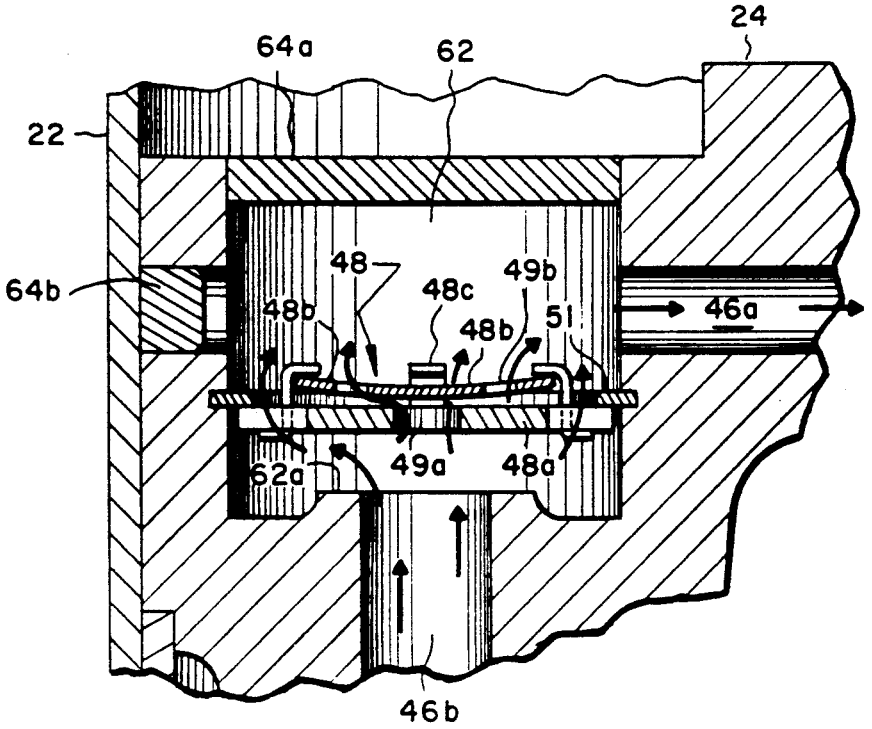

Under the circumstances of reverse direction scroll rotation illustrated in FIGS. 5 and 9, internal gas flow within the compressor is out of the suction pressure portion of the compressor shell through passage 46. The flow occurs in a manner which lifts both valve assembly 48 off of seating surface 62*a* and valve portion 48*b* off of valve portion 48*a* so that aperture 49*a* of valve portion 48*a* and apertures 49*b* of valve portion 48*b* are all open to flow. As a result, a relatively large and unrestricted volume of gas, which is required to protect the compressor under such circumstances, flows through and around valve assembly 48.

Under the circumstance of the existence of abnormally high discharge temperatures, valve portion 48*b* responds by deforming to the diaphragmed shape illustrated in FIGS. 6 and 10. The diaphragming of valve portion 48*b* in this manner places apertures 49*b* of valve portion 48*b* in flow communication with aperture 49*a* of valve portion 48*a*. As a result, discharge pressure gas is permitted to flow internally through the apertures in the valve assembly components and through passage 46. The abnormally hot discharge pressure gas then flows to the suction portion of the compressor shell at a location proximate thermally actuated line break device 60 which is disposed on the motor stator.

The discharge gas issuing from passage portion 46*b* causes the line break device 60 to be heated such that electrical continuity within the motor is interrupted and the motor is de-energized. The thermal characteristics of valve portion 48*b* and line break device 60 are selected to ensure their operation and the shutdown of the compressor motor before discharge temperatures reach levels which can cause damage to the compressor.

It is to be noted that the requirement for flow of gas through valve assembly 48 which occurs when discharge temperatures become exceedingly high is much less from a volume standpoint than with respect to the flow which is permitted and required under the circumstance of reverse direction rotation. Therefore, under the circumstance of high discharge temperature, the cross sectional flow area through the valve assembly need not be as large as with respect to the circumstance of reverse direction scroll rotation.

This is advantageous from the standpoint that under the circumstance of the existence of high discharge temperatures valve portion 48*b* must deform against discharge pressure in order to open. Through its design, the present invention advantageously permits valve portion 48*b* to be of relatively small cross sectional area thereby reducing the surface area of the portion of the valve which must act against discharge pressure in order to diaphragm and open under the circumstance of the existence of high discharge temperatures.

The protective apparatus of the present invention is equally applicable to compressors which do not have an internal discharge check valve assembly such as where the discharge check valve is disposed downstream of the discharge pressure portion of the compressor shell. If the discharge check valve assembly is located downstream of the discharge pressure portion of the compressor shell it will be appreciated that protective refrigerant flow passage 46 which, in net effect, is a short-circuit between a discharge pressure and a suction pressure portion of the compressor, can be located anywhere within the compressor so long as it opens both into the discharge and suction pressure portions of the shell.

Figure 13:
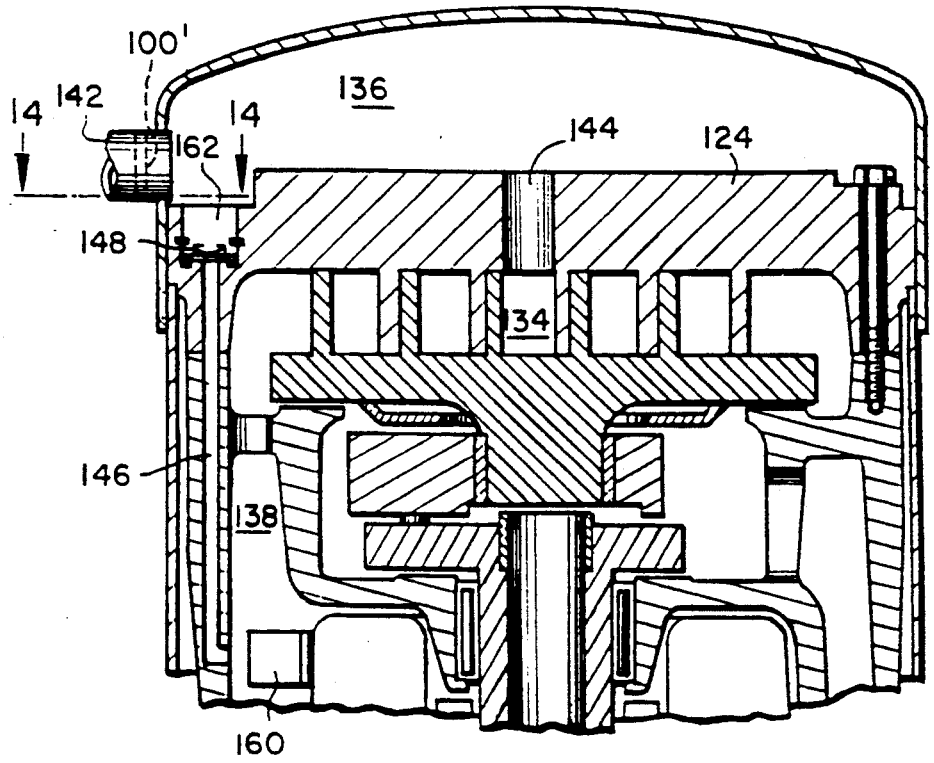
FIGS. 13 and 14 are illustrative of a first alternative embodiment of the present invention.
Figure 14:
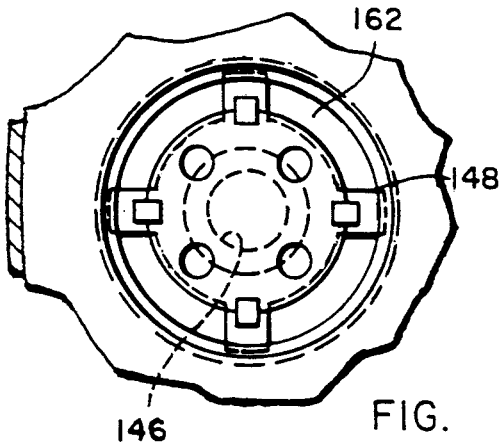
Figure 7:
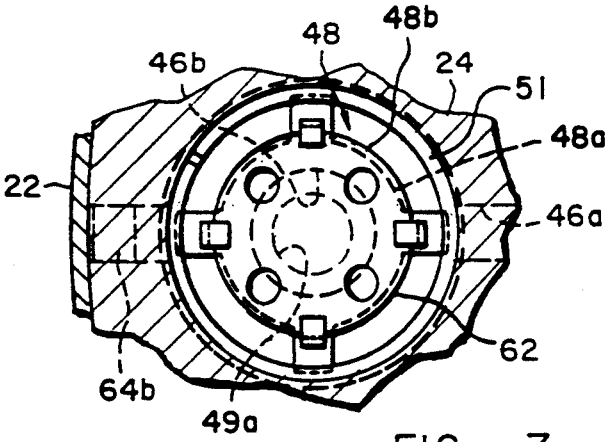
FIG. 7 is a view taken along the line 7—7 in FIG. 2.

One such embodiment is illustrated in FIGS. 13 and 14 wherein internal refrigerant passage 46 is illustrated to be an essentially straight passage through the fixed scroll member 124 and wherein discharge check valve 100' is schematically illustrated as being disposed in discharge port element 142. In this embodiment, valve assembly 148 is disposed in chamber 162 which communicates with the discharge pressure portion 136 of the compressor shell and therethrough, with discharge passage 144 and discharge pocket 134. Valve member 148 is retained in chamber 162 by retainer 150. The compressor protection apparatus of this embodiment operates on the same principles as the apparatus disclosed in FIGS. 1–12.

Figure 15:
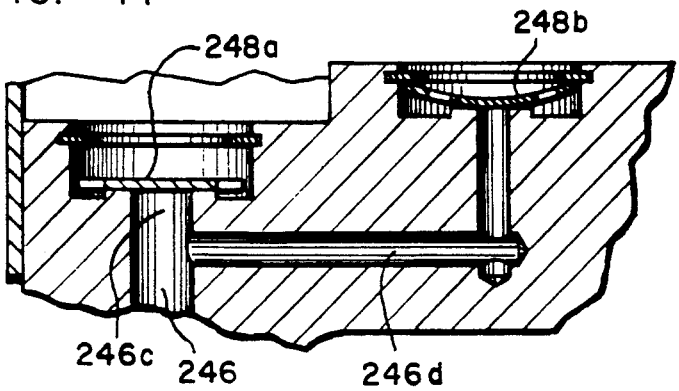
FIG. 15 is illustrative of a second alternative embodiment of the present invention.

Referring to FIG. 15, a still further embodiment of the present invention is disclosed. In the FIG. 15 embodiment, passage 246 is a branched passage consisting of branch passages 246*c* and 246*d*. In normal operation, passage 246 is occluded by valve portions 248*a* and 248*b* at spaced apart locations.

Valve portions 248*a* and 248*b* operate in the same manner as has been described above when exposed to respective reverse direction scroll rotation or high discharge temperature conditions although, as will be appreciated, valve portion 248*a* of this embodiment will not have an aperture. Branch 246*c* of passage 246 is of substantially greater cross sectional area than is branch passage 246*d*. Once again, under the circumstance of reverse direction scroll rotation gas flow through passage 246 is through the relatively large volumes defined by both of branch passages 246*c* and 246*d* while under the circumstance of high discharge pressure and the need for deformation of valve portion 248*b*, gas passes only through relatively smaller branch passage 246*d* from the discharge to the suction pressure portions of the compressor.

While the present invention has been described in terms of a preferred and first and second alternative embodiments, it will be appreciated that other embodiments will fall within the scope of this invention so that it is to be limited only in accordance with the language of the claims which follow:

What is claimed is:

1. A scroll compressor comprising:

a shell through which a gas flows when said compressor is in operation, said shell defining a suction pressure portion and a discharge pressure portion;

a first scroll member disposed in said shell, said first scroll member having an involute wrap and defining a discharge aperture in flow communication with said discharge pressure portion of said shell;

a second scroll member disposed in said shell, said second scroll member having an involute wrap in interleaving engagement with the involute wrap of said first scroll member and cooperating therewith to define a plurality of compression pockets, one of said pockets being a discharge pocket which is in flow communication with said discharge aperture and out of which compressed gas flows when said compressor is in normal operation;

means for defining a passage internal of said shell between said suction pressure portion and said discharge pocket; and means for permitting selective bi-directional gas flow between said discharge pocket and said suction pressure portion of said shell through said passage, said means for permitting selective bi-directional flow comprising a valve assembly, said valve assembly including a thermally responsive portion and a portion other than said thermally responsive portion, both said thermally responsive portion of said assembly and said portion of said valve assembly other than said thermally responsive portion defining at least one aperture, said assembly being operable to permit the flow of gas in a first direction and at a first rate when gas pressure in said discharge pocket is less than gas pressure in said suction pressure portion of said shell and in a direction opposite said first direction and at a second rate which is less than said first rate when discharge gas temperature exceeds a predetermined temperature.

2. The compressor according to claim 1 wherein under normal compressor operating conditions said thermally responsive portion of said valve assembly occludes said aperture of the portion other than said thermally responsive portion of said valve assembly and cooperates with said portion of said valve other than said thermally responsive portion to occlude said passage.

3. The compressor according to claim 2 wherein the existence of abnormally high discharge temperatures in said compressor causes said thermally responsive portion of said valve assembly to deform in a manner which opens said passage to gas flow at said second flow rate by restricting the amount of gas flowing therethrough to the amount of gas capable of being passed first through said aperture defined by said thermally responsive valve portion and next through said aperture defined by the portion of said valve assembly other than said thermally responsive portion.

4. The compressor according to claim 3 wherein the reverse direction rotation of said compressor causes said valve assembly to be positioned within said passage in a manner such that said thermally responsive portion of said valve assembly does not substantially limit the flow of gas through said passage.

5. The compressor according to claim 3 wherein said thermally responsive portion of said valve assembly is movable within said assembly and wherein the reverse direction rotation of said compressor causes said valve assembly to be positioned in said passage and said thermally responsive portion to be positioned in said valve assembly such that the flow of the gas through said passage is through the respective apertures of and around both said thermally responsive portion and said portion other than said thermally responsive portion of said valve assembly.

6. A scroll compressor comprising:

a shell through which gas flows when said compressor is in operation, said shell defining a suction pressure portion and a discharge pressure portion;

a first scroll member fixedly mounted in said shell, said first scroll member having an involute wrap and defining a discharge aperture in flow communication with said discharge pressure portion of said shell;

a second scroll member rotatably disposed in said shell for orbital motion with respect to said involute wrap of said fixed scroll member, said second scroll member having an involute wrap in interleaving engagement with the involute wrap of said first scroll member and cooperating therewith to define a plurality of compression pockets, one of said pockets being a discharge pocket which is in flow communication with said discharge aperture and out of which compressed gas flow when said compressor is in normal operation;

means for defining a passage between said suction pressure portion of said shell and said discharge pocket; and a movable valve assembly disposed in said passage, said valve assembly having a thermally responsive portion which is itself movable within said valve assembly and a portion other than said thermally responsive portion, said thermally responsive portion of said valve assembly and said portion of said valve assembly other than said thermally responsive portion each defining at least one aperture and said valve assembly occluding said passage under the circumstance of normal compressor operating conditions, said valve assembly being positionable to (i) permit gas flow through said passage from said suction pressure portion of said shell to said discharge pocket at a first flow rate when gas pressure in said discharge pocket is less than gas pressure in said suction pressure portion of said shell and (ii) permit the flow of gas through said passage from said discharge pocket to said suction pressure portion of said shell at a lesser flow rate than said first flow rate when the temperature of discharge gas exceeds a predetermined temperature.

7. The scroll compressor according to claim 6 wherein, under the circumstance of gas pressure in said discharge pocket being less than gas pressure in said suction pressure portion of said shell, gsa is permitted to flow from said suction pressure portion of said shell to said discharge pocket through the aperture of and around said thermally responsive portion of said valve assembly and through the aperture of and around the portion of said valve assembly other than said thermally responsive portion.

8. The scroll compressor according to claim 6 wherein under the circumstance of discharge gas temperature exceeding said predetermined temperature said thermally responsive portion of said valve assembly deforms to permit discharge gas to flow through but not around the aperture defined by said thermally responsive portion of said valve assembly and through but not around the aperture defined by said portion of said valve assembly other than said thermally responsive portion.

9. The scroll compressor according to claim 6 wherein under normal compressor operating conditions a solid portion of said thermally responsive portion of said valve assembly occludes said aperture defined by said portion of said valve assembly other than said thermally responsive portion and wherein, under the circumstance of discharge gas temperature exceeding said predetermined temperature, said thermally responsive portion deforms within said valve assembly.

10. The scroll compressor according to claim 9 wherein, under the circumstance of gas pressure in said discharge pocket being less than gas pressure in said suction pressure portion of said shell, gas is permitted to flow through said suction pressure portion of said shell to said discharge pocket through the aperture of and around said thermally responsive portion of said valve assembly and through the aperture of and around the portion of said valve assembly other than said thermally responsive portion.

11. The scroll compressor according to claim 9 wherein under the circumstance of discharge gas temperature exceeding said predetermined temperature, discharge gas is permitted to flow through but not around the aperture defined by said thermally responsive portion of said valve assembly and through but not around the aperture defined by said portion of said valve assembly other than said thermally responsive portion.

12. The scroll compressor according to claim 6 wherein said thermally responsive portion of said valve assembly is retained in said valve assembly such that (i) its deformation under the circumstance of discharge gas temperature exceeding said predetermined temperature is accommodated internal of said valve assembly and (ii) its movement, in an undeformed state, is permitted so as to open said aperture in said portion of said valve assembly other than said thermally responsive portion under the circumstance of gas pressure in said discharge pocket being less than gas pressure in said suction pressure portion of said shell.

* * * * *